US005454893A

United States Patent [19]

Dietz

[11] Patent Number: 5,454,893

[45] Date of Patent: Oct. 3, 1995

[54] METHOD FOR EFFECTING A GAS EXCHANGE IN A MULTIPLATE INSULATING GLASS UNIT

[75] Inventor: Rainer Dietz, Neu-Isenburg, Germany

[73] Assignee: Metallgesellschaft Aktiengesellschaft, Frankfurt Am Main, Germany

[21] Appl. No.: 230,752

[22] Filed: Apr. 21, 1994

[30] Foreign Application Priority Data

Apr. 21, 1993 [DE] Germany ..... 43 12 956.0

[51] Int. Cl.[6] ..... E06B 3/677

[52] U.S. Cl. ..... 156/104; 156/109; 156/286; 141/65; 141/66

[58] Field of Search ..... 156/109, 104, 156/286; 52/172; 428/34; 141/8, 63, 65, 66; 53/403, 468, 490, 319; 425/536; 264/526, 528

[56] References Cited

U.S. PATENT DOCUMENTS 4,450,660 5/1984 Dean et al. ..... 52/172

FOREIGN PATENT DOCUMENTS 2555384 3/1982 Germany .
2555383 9/1988 Germany .
4100697 8/1991 Germany .
7008355 of 1970 Japan ..... 425/536

*Primary Examiner*—Michael W. Ball
*Assistant Examiner*—Sam Chuan Yao
*Attorney, Agent, or Firm*—Michael J. Striker

[57] ABSTRACT

The tubular tool for use in effecting a gas exchange in multiplate insulating glass units provided with a sealant spacer has a sharpened end (1) like a plug drill and is provided with a handle portion (2) at the other end. The handle portion (2) has a port (3) for connection to a device which exchanges gas in a space between glass plates of the insulating glass unit. The wall of the tubular tool (20) is provided with throughgoing openings (4) in a portion between the sharpened end (1) and the handle portion (2). The tubular tool also can have a portion without throughgoing openings having a length approximately equal to a thickness of the sealant spacers both at the sharpened end and at the handle portion.

6 Claims, 2 Drawing Sheets

METHOD FOR EFFECTING A GAS EXCHANGE IN A MULTIPLATE INSULATING GLASS UNIT

BACKGROUND OF THE INVENTION

The present invention relates to a device for gas exchange in a multiplate insulating glass unit and its use.

Published German Patent Applications DE-C-25 55 383 and DE-C-25 55 384 describe insulating glass units comprising glass panes, which include spacers consisting of mixed sealants. Previously it has been possible to effect an exchange of gases enclosed between the insulating glass plates only in special presses, such as have been disclosed in German Published Patent Applications DE-A-41 00 697, because of the consistency of the spacer material. In that case, loss of filling gases, which are expensive or would pollute the environment, must be expected and the degree to which the gases are exchanged can still be improved. Besides, it has not been possible to adapt the insulating glass panes to different pressure conditions and the glass plates are deformed to a convex or concave shape in response to changes in the external pressure from pressure conditions prevailing during manufacture.

SUMMARY OF THE INVENTION

It is an object of the present invention to provide a device for effecting a gas exchange in a multiplate insulating glass unit which avoids the disadvantages of the prior art.

According to the invention the device for effecting a gas exchange in a multiplate insulating glass unit having a sealant spacer consists of a tubular tool sharpened at one end like a plug drill and provided at the other end with a handle portion, which is provided with a port for connection to an apparatus for effecting a gas exchange. The wall of the tubular tool is provided with openings in a portion which is between the sharpened end and the handle portion.

The device according to the invention has the following advantages.

1. The space between the plates is not soiled by a drilling operation.
2. The spacer is not permanently deformed because the device according to the invention receives the material which has been drilled out.
3. The device according to the invention acts both as a filling nozzle and as a suction nozzle so that an efficient filling with gas can be effected without a tool change.
4. As the device according to the invention is removed, the opening left, e.g. in the sealant spacer, by its removal is quickly and reliably closed since the drilled core which has been drilled out is inserted into the drilled passage.
5. Gas losses are minimized and there is no need for subsequently sealing the drilled passage by riveting or stuffing.
6. The point of application complies with esthetic requirements because even when the work is performed quickly the drilled out material is neatly reinserted into the drilled passage after gas exchange.
7. The device automatically cleans itself as it is extracted so that the filling of the next unit can immediately be started.
8. The gas exchange may be effected with the same device before or after the application of the secondary sealant. In the latter case, it is not necessary to provide recesses at the filling location because the device discharges the elastomer. When the device has been removed the core consisting of the secondary sealant and the primary sealant remains in the drilled passage at an offset depth so that resealing can occur as usual.
9. For this reason the device permits also a subsequent adaptation of the internal pressure of the pane to pressure conditions which differ from the conditions during manufacture.

It is desirable to provide no openings in the wall of the tubular tool at the sharpened end and in front of the handle portion in a portion which is approximately equal to the thickness of the sealant spacer. In that case, a region for receiving the drilled-out sealant core is provided and loss of gas is avoided because the sealant spacer is in snug contact with the device.

According to an additional desirable feature of the device the openings in the wall of the tubular tool are throughgoing holes passing through the wall of the tubular tool at right angles to the axis of the tube and are spaced 90° apart. In conjunction with the sealing of the sharpened end by the drilled-out core, the arrangement of openings permits a favorable gas exchange and provides a high stability for the tubular tool.

Another desirable feature of the device resides in two mutually opposed stubs provided on opposite sides of the handle portion. This permits supply and discharge of the gas to be separately effected and the mutually opposed tubular ports permit an improved transmission of force for inserting and extracting the device through the sealant into the space between the glass plates.

In a preferred embodiment of the invention the tubular tool has an outside diameter which can be as large as approximately one-half the distance between the glass plates. In that case the device can be moved through the sealant spacer so that a contact with the adjoining glass plates is avoided. As a result, a soiling of the glass plates by the sealant of the sealant spacer and the sealing problems which would arise if the drilled passage is in direct contact with one or both glass plates is avoided. Besides, the dimensioning of the device ensures an esthetic appearance of the point of application.

In a method according to the invention for using the device for effecting a gas exchange according to the invention at least one device is inserted through the sealant spacer at at least one location through the sealant spacer into the space between the glass plates. After that, the gas exchange is effected, the device extracted after the gas exchange and the space between the glass plates is subsequently closed by insertion of the drill core into the drilled passage.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENTS

Figure 1:
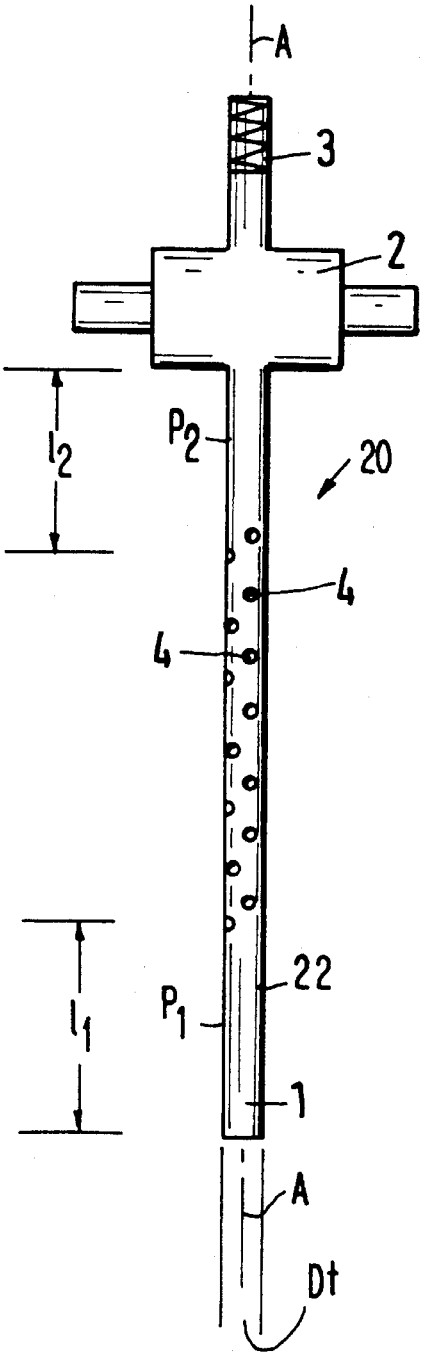
FIG. 1 is a side view of a device for effecting a gas exchange in a multiplate insulating glass unit.

A preferred embodiment of the invention is shown in FIG. 1. The device shown in FIG. 1 comprises a tubular tool 20 having a sharpened end 1, a handle portion 2 at an end opposite to the sharpened end 1. The handle portion 2 has a port 3 for making a connection to an apparatus for effecting a gas exchange. The tubular tool 20 is provided with a plurality of openings 4 in its wall 22.

Figure 2:
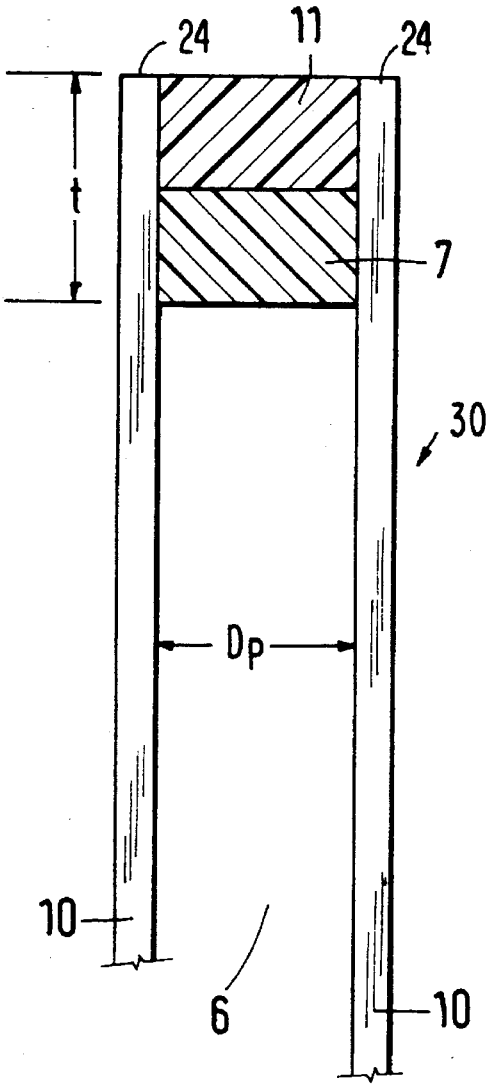
FIG. 2 is a cross-sectional view of a multiplate insulating glass unit having a space containing a gas to be exchanged.

A portion of a multiplate insulating glass unit 30 is shown in FIG. 2. The portion of the glass unit 30 shown consists of two glass plates 10 and an adhesive joint formed at their edges 24 by a sealant or sealant spacer 7. To provide an increased mechanical stability the glass plates 10 can also be sealed at their edges 24 by an elastomer 11.

Figure 3:
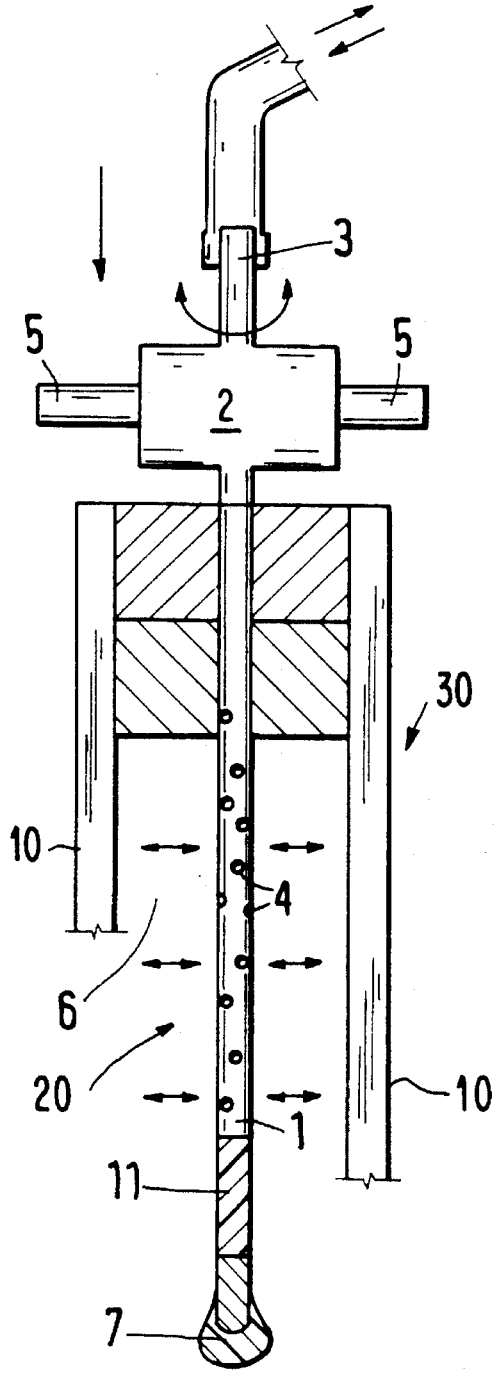
FIG. 3 is an action view of a device according to the invention in a multiplate insulating glass unit in position for gas exchange.

FIG. 3 shows the device according to the invention in operation in position for gas exchange. The device according to the invention is inserted with its sharpened end 1 into the drilled-out sealant spacer 7 and the optional drilled-out elastomer 11. The stubs 5 on the handle portion 2 facilitate insertion and extraction of the device into and out of the space 6 between the glass plates 10. In other embodiments not shown in the drawing the stubs 5 may consist of tubular ports 3 to permit separate discharge and supply of gas.

In the preferred embodiment of the device according to the invention the tubular tool 22 also has a portion $P_1$ without throughgoing holes at the sharpened end 1 having a length $\mathbf{1}_1$ approximately equal to a thickness t of the sealant spacer 7 and optional elastomeric layer 11 and another portion $P_2$ without throughgoing holes in front of the handle portion 2 having a length $l_2$ approximately equal to a thickness t of the sealant spacer. As seen in FIG. 3 a drilled core is shown at the sharpened end 1.

In the preferred embodiment also the openings (4) are throughgoing holes passing through the wall 22 at right angles to an axis (A) of the tubular tool 20 and spaced 90° apart. Also tubular tool (20) has an outside diameter ($D_t$) approximately one-half of a distance ($D_p$) between the glass plates.

Figure 4:
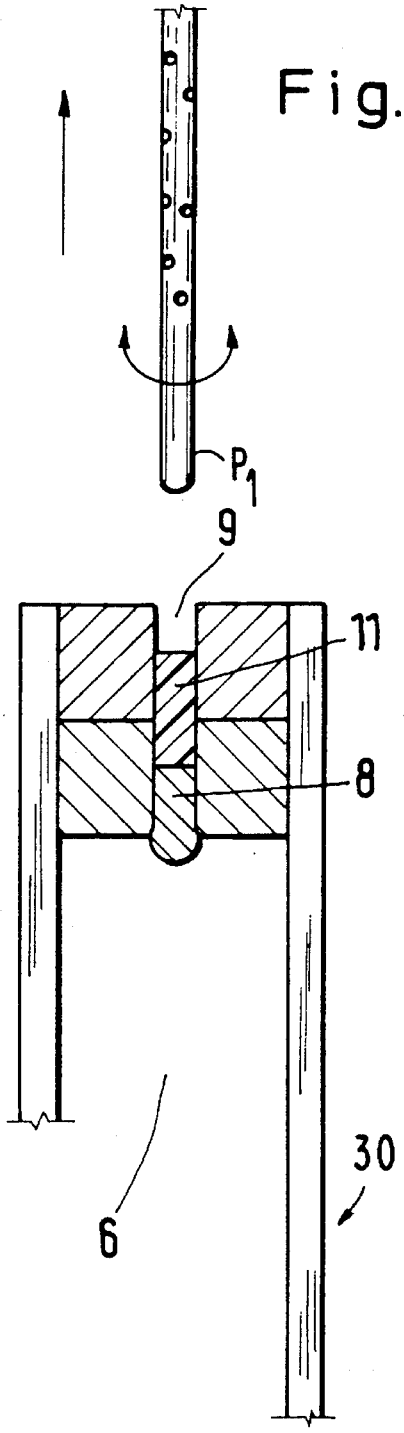
FIG. 4 is another action view of the device according to the invention after extraction from the multiplate insulating unit.

Finally, FIG. 4 shows the multiplate insulating glass unit 30 after the gas exchange has been effected. As the tubular tool is extracted from the space 6 between the glass plates, the drilled-out core 8 is in the drilled passage 9 at a different depth. For an improved seal the remaining recess may be filled up with the elastomer 11 which has been inserted.

While the invention has been illustrated and described as embodied in a device for effecting a gas exchange in a multiplate insulating glass unit, it is not intended to be limited to the details shown, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A method for effecting a gas exchange in a multiplate insulating glass unit having a sealant spacer, said method comprising the steps of:

a) providing at least one tubular tool (20) for exchanging gas, said at least one tubular tool (20) having a sharpened end (1), a handle portion (2) with a port#(3) at an end remote from said sharpened end (1) and a wall (22) with a plurality of throughgoing openings (4) between the sharpened end (1) and the handle portion (2);

b) inserting said at least one tubular tool (20) at at least one location through a sealant spacer into a space (6) containing a gas to be exchanged between two glass plates (10) of said multiplate insulating glass unit so that at least one drill core is formed by action of the at least one tubular tool (20) the sealant spacer (1);

c) exchanging said gas in said space (6) through said at least one tubular tool (20);

d) subsequently extracting the at least one tubular tool (20) from the sealant spacer and inserting the at least one drill core into an at least one throughgoing passage in said sealant spacer formed by the inserting of step b).

2. A method as defined in claim 1, further comprising providing a portion ($P_1$) of said tubular tool (22) at said sharpened end (1) and another portion ($P_2$) of said tubular tool (22) in front of said handle portion (2), said portion ($P_1$) being free of throughgoing holes and having a length ($l_1$) approximately equal to a thickness (t) of said sealant spacer and said other portion ($P_2$) being free of said throughgoing holes and having a length ($l_2$) approximately equal to said thickness (t) of said sealant spacer.

3. A method as defined claim 1, wherein said openings (4) pass through said wall (22) at right angles to an axis (A) of said tubular tool and are spaced at 90° intervals around a circumference of said wall.

4. A method as defined in claim 1, further comprising providing said handle portion (2) with two mutually opposed stubs (5) on opposite sides of said handle portion (2).

5. A method as defined in claim 1, wherein said tubular tool (20) has an outside diameter ($D_t$) approximately one-half of a distance ($D_p$) between said glass plates.

6. Method of exchanging gas inside a multiplate insulating glass unit consisting of a plurality of glass plates and an adhesive joint between the glass plates, said adhesive joint being located at edges of the glass plates and comprising a sealant spacer between the glass plates, said method comprising the steps of:

a) providing at least one tubular tool (20) for gas exchange, each of said at least one tubular tools (20) having a sharpened end (1), a handle portion (2) provided with a port (3) at an end remote from said sharpened end (1) and a wall (22) with a plurality of throughgoing openings (4) between the sharpened end (1) and the handle portion (2);

b) at at least one location on the sealant spacer, inserting the at least one tubular tool (20) through the sealant spacer into a space (6) containing a gas to be exchanged between two of the glass plates (10) of said multiplate insulating glass unit so that at least a portion of the throughgoing openings (4) open into the space (6) for gas exchange through the at least one tubular tool and so that at least one drill core is formed by action of the sharpened end (1) of the at least one tubular tool (20) on the sealant spacer;

c) after the inserting of step b), exchanging said gas in said space (6) through said at least one tubular tool (20); and d) after the exchanging of step c), extracting the at least one tubular tool (20) from the sealant spacer and inserting the at least one drill core formed in the inserting of step b) in at least one throughgoing passage in said sealant spacer formed during said inserting.

* * * * *